US007891993B2

(12) United States Patent
Huber et al.

(10) Patent No.: US 7,891,993 B2
(45) Date of Patent: Feb. 22, 2011

(54) POWER RAIL SYSTEM

(75) Inventors: Arthur Huber, Fürstenzell (DE); Josef Feigl, Arnstorf (DE); Christian Stepputat, Passau (DE)

(73) Assignee: Knuerr AG, Arnstorf (DE)

( * ) Notice: Subject to any disclaimer, the term of this patent is extended or adjusted under 35 U.S.C. 154(b) by 0 days.

(21) Appl. No.: 12/442,671

(22) PCT Filed: Oct. 15, 2007

(86) PCT No.: PCT/EP2007/008937

§ 371 (c)(1),
(2), (4) Date: Mar. 24, 2009

(87) PCT Pub. No.: WO2008/046577

PCT Pub. Date: Apr. 24, 2008

(65) Prior Publication Data

US 2010/0041277 A1 Feb. 18, 2010

(30) Foreign Application Priority Data

Oct. 16, 2006 (DE) ..... 20 2006 015 827 U

(51) Int. Cl.
*H01R 25/00* (2006.01)

(52) U.S. Cl. ..... 439/110; 439/119

(58) Field of Classification Search ..... 439/100, 439/116–119, 110

See application file for complete search history.

(56) References Cited

U.S. PATENT DOCUMENTS

| | | | | |
|---|---|---|---|---|
| 5,788,517 | A | 8/1998 | Elmouch | |
| 6,220,880 | B1 * | 4/2001 | Lee et al. | 439/214 |
| 6,830,477 | B2 * | 12/2004 | Vander Vorste et al. | 439/535 |
| 7,252,524 | B1 * | 8/2007 | Johnson et al. | 439/210 |
| 7,400,493 | B2 * | 7/2008 | Ewing et al. | 361/623 |
| 7,438,566 | B2 * | 10/2008 | Chen | 439/110 |
| 7,457,106 | B2 * | 11/2008 | Ewing et al. | 361/623 |
| 7,544,071 | B2 * | 6/2009 | Jong | 439/113 |
| 7,556,511 | B1 * | 7/2009 | Hsu et al. | 439/119 |
| 2005/0070166 | A1 | 3/2005 | Brandt et al. | |
| 2006/0063434 | A1 | 3/2006 | Bergmann et al. | |

FOREIGN PATENT DOCUMENTS

| | | | |
|---|---|---|---|
| DE | 298 02 689 | U1 | 9/1998 |
| DE | 10 2005 040859 | A1 | 7/2006 |
| EP | 1 521 511 | A | 4/2005 |

* cited by examiner

*Primary Examiner*—Thanh-Tam T Le

(57) ABSTRACT

The invention relates to a power rail system comprising a power-conducting base structure and at least one module for power distribution and/or power supply fittable to the base structure wherein said power-conducting base structure over substantially the entire length has at least power lines constructed as first contact devices, wherein the said at least one power distribution and/or power supply module has second contact devices for contacting with said first contact devices of said base structure and contacting takes place at a random location on or with said base structure.

14 Claims, 3 Drawing Sheets

POWER RAIL SYSTEM

CROSS-REFERENCE TO RELATED APPLICATIONS

Figure 1:
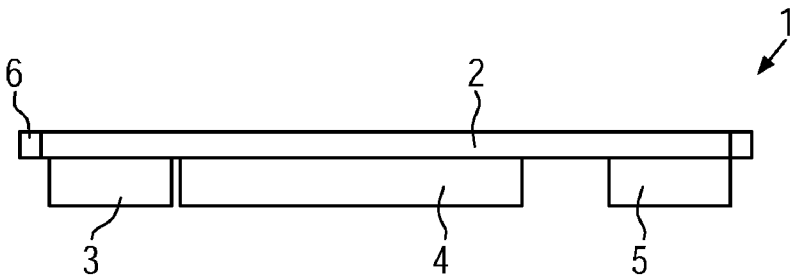

This application is a 371 U.S. National Stage of International Application No. PCT/EP2007/008937, filed Oct. 15, 2007. This application claims the benefit of Foreign Patent Application No. DE 20 2006 015 827 8, filed Oct. 16, 2006. The disclosures of the above applications are incorporated herein by reference.

The invention relates to a power rail system according to the preamble of claim 1.

In order to supply power to loads in casings and cabinets in the information technology field, use is generally made of socket strips or socket boards. Said socket strips are frequently provided with fastening devices enabling them to be fixed in or on such casings and cabinets. However, the nature of the sockets is predetermined in the case of such socket strips, so that a further socket strip must be installed for loads requiring a different socket type.

A comparable system is known for 19" server cabinets, where there is a base structure fitted vertically in the server cabinet. At fixed intervals said base structure has connections for terminals to which random socket strips can be plugged. This permits a replacement of a single socket strip. The power lines are provided in said base structure.

A disadvantage of this construction is that as a result of the connection devices at fixed, predetermined intervals, the socket strips can only be fitted in specific, predetermined positions.

An aim is therefore to keep cabling effort to a minimum, i.e. to use cables of minimum length, so that it is desirable to make the sockets available as close as possible to the corresponding loads.

The object of the invention is therefore to provide a power rail system for supplying loads, in which the distribution devices can be positioned as close as possible to the load and which can be easily extended and adapted.

According to the invention this object is achieved by a power rail system having the features of claim 1.

Thus, the power-conducting base structure has essentially over the entire length power lines constructed as first contact devices and at least one module for the power distribution and/or power supply has second contact devices for contacting with the first contact devices of the base structure. Contacting also takes place at a random point on or with the base structure.

Further advantageous embodiments are given in the dependent claims, description and drawings and their explanation.

It is a fundamental concept of the invention when designing the power rail system to ensure that on positioning the modules for power distribution and/or power supply purposes a high degree of freedom remains available. This is achieved according to the invention in that the power-conducting base structure has contact devices over its entire length. These contact devices can e.g. be constructed as power rails. The power distribution modules have a further, second contact device in order to contact the power rails. Contacting brings about a power-transmitting connection between the base structure and the modules. As the power rails run continuously over the entire length of the base structure in the form of a contact device, it is possible to connect the power distribution modules to the base structure at a random location. Thus, the power distribution modules can be fitted as close as possible to the given loads.

Another advantage is the possibility of the simultaneous use of different power distribution modules. The different modules can e.g. have different plug-in locations for the loads or, as a function of the design, can also offer different voltages or can be differently protected by means of fuses.

The power distribution modules can have a random construction. However, preferably their design is based on the connection possibilities or prior requirements of the loads. Thus, it is e.g. possible to provide the power distribution modules in the form of terminal strips for open cabling. It is also advantageous to implement said modules in the form of socket strips. This facilitates the connection of loads. Through the use of individual modules it is possible to implement several modules with a different socket arrangement adapted to the given loads. Thus, also other specific plug types or different national and/or standard-specific socket systems can be used.

In a preferred further development, the base structure has data lines in addition to the power lines. Said data lines are constructed as further, third contact devices. It is advantageous if at least one module has a further contact device for connection to the third contact devices.

This permits a data transfer via the data lines.

In principle, communication via the data lines can be controlled from any random location. Thus, a corresponding communication device can e.g. be provided directly on the power-conducting base structure. Another advantageous possibility is to provide a further module as a communication module and which has at least contact devices for contacting data lines. This module should also be designed for transmitting and/or receiving information on said data lines.

When using an additional module for data communication, the basic version can be provided without the additional data distribution devices and can then be subsequently upgraded if such a further functionality is needed.

It is advantageous in this connection if at least the power distribution /or power supply module also has devices for transmitting and/or receiving information on the data lines. This makes it possible for the communication module or some other communication device to receive data from the power supply and/or power distribution modules. This e.g. permits a simple monitoring or control of the total power supplied or of the individual modules.

It is also possible to implement further monitoring mechanisms via such a functionality. For example the communication module can be designed in such a way that the position of the individual distribution modules can be determined through corresponding algorithms. If the communication module also has an interface to the network or to management and operating systems, said information can be used or polled for maintaining or for the present use conditions. Therefore in situ maintenance is no longer necessary. Further possibilities are constituted by a planned disconnection of individual sockets or loads.

The communication module can advantageously be designed in such a way that the power or voltage measurement can be broken down to individual modules or sockets or individually determined for the same. The protection of the individual modules or socket strips can also be indicated or monitored by the communication module.

To improve module contact with the base structure, it is advantageous for the modules to have prong- or tongs-like coupling elements for engaging with said base structure and are preferably fitted to the marginal area of the modules in each case.

It has also proved advantageous for reliable contacting for the first and/or third contact devices to be constructed as female contact devices and the second and/or fourth contact devices as matching, male contact devices. This firstly leads to the advantage that the power lines and contact devices, which are implemented in the form of female devices, are positioned in protected manner on the base structure and an undesired contacting is prevented. The projecting, prong- or tongs-like coupling elements provided on the modules serve to protect the male, projecting contact devices, so that the latter cannot be bent or damaged.

Fundamentally the contact devices can be constructed in male/female or female/male manner and preference is given to a construction with contact protection.

In a further advantageous embodiment the modules are equipped with at least one locking device, which is preferably fitted in the end area of the given module. Such a locking device is used for the additional fastening of the modules to the base structure, so that undesired slipping or removal is prevented.

Apart from the possibility of remote diagnosis via the communication module, which is advantageously designed for communication with control and/or monitoring systems, it is also possible to provide additional display devices for outputting information to the individual modules. It is e.g. possible to provide LEDs with different colours in order to indicate the occupancy status of the individual sockets on a distribution module. It is also possible to have LCD monitors or multisegment displays for the modules in order to display information on the present power load, the connected loads or error messages.

Similarly indication displays can be provided at random locations of the base structure or adaptable with modules.

This facilitates the in situ monitoring, so that with such a maintenance procedure there is no need for a long and detailed diagnosis and checking test for establishing functionality. The display devices can additionally have input devices in order to hit or poll any error analyses or specific outputs.

In an advantageous embodiment the end pieces of the base structures have the possibility of attaching a further power-conducting base structure. This enables the inventive power rail system to be easily extended, so that it can be adapted to a larger number of loads without having to carry out significant modifications in the overall system.

As the electronic subassemblies and loads are being placed ever closer together in electronic casings and cabinets, electronic cabinets or 19" server cabinets for short, the power demand for such a cabinet is also increasing. Also for this reason the power rail system is designed in an advantageous embodiment for the transmission and conducting of several current phases. The base structure then has at least one power line per phase.

Through the possibility of only contacting specific power lines, the power modules are in a position to offer different phases or also several phases for the loads to be connected. It is also possible for different power distribution modules to use different phases, in order to e.g. uniformly distribute the load over all the phases.

Figure 2:
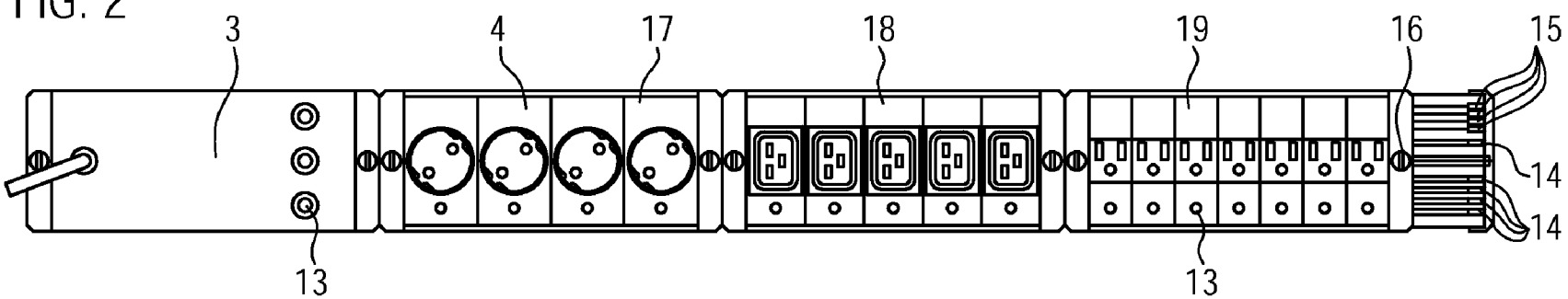
Figure 3:
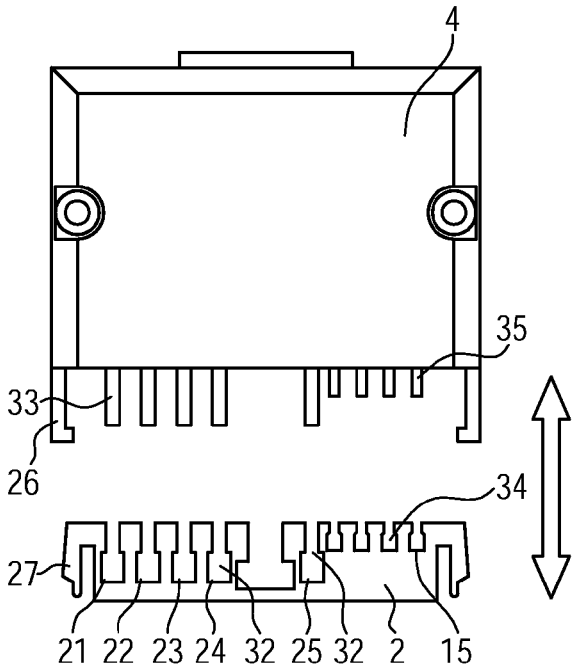
Figure 4:
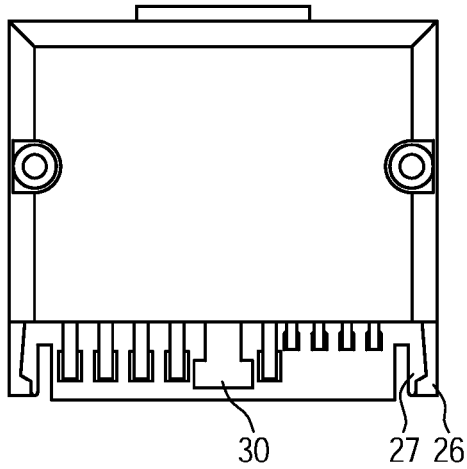
Figure 5:
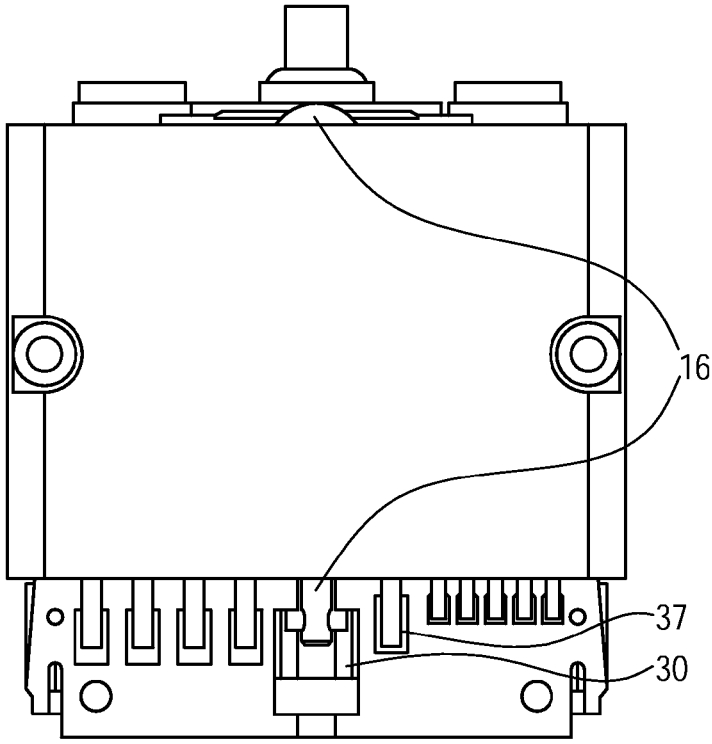
Figure 6:
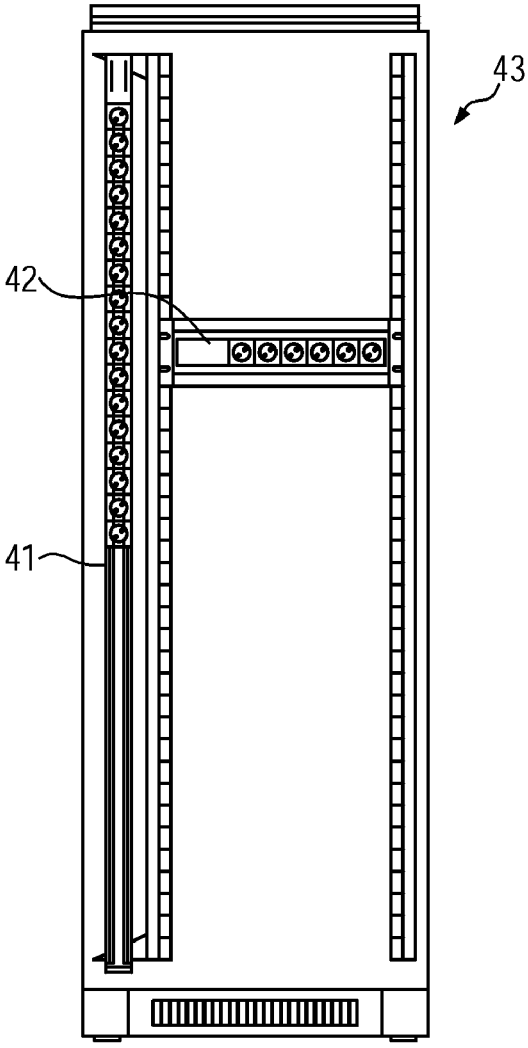

The invention is described in greater detail hereinafter relative to embodiments and attached diagrammatic drawings, wherein show:

FIG. 1 a basic diagram of an inventive power rail system;

FIG. 2 a plan view of a power rail system with different modules;

FIG. 3 a sectional view through a module and a base structure prior to insertion;

FIG. 4 a sectional view through the module and the base structure of FIG. 3 following insertion;

FIG. 5 a sectional view through a module and a base structure with locking device;

FIG. 6 a server cabinet with two built-in power rail systems; and

Figure 7:
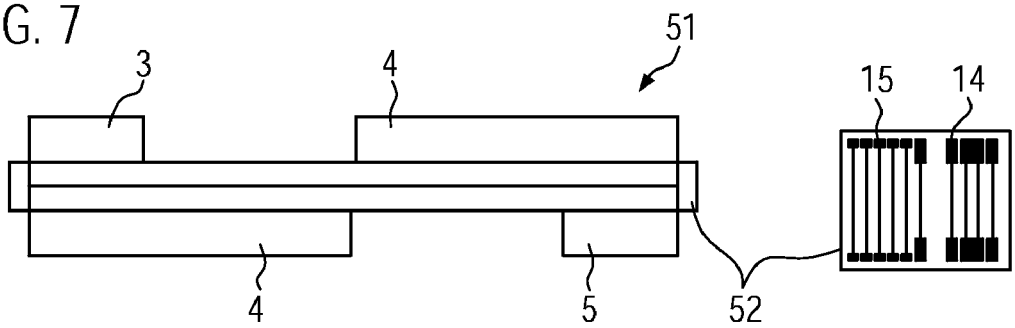

FIG. 7 a basic diagram of a double power rail system with coupling end piece.

FIG. 1 is a basic diagram of a power rail or power bar system 1 according to the invention. The here shown power bar system 1 has a base structure 2 with in each case two end pieces 6. A power supply module 3, a power distribution module 4 and a communication module 5 are fitted to the base structure 2.

In another design it can be appropriate to integrate the communication module into the supply module, e.g. in that it is provided on a plug-in board in said supply module.

According to FIG. 1 the power supply module 3 is connected to the local power supply system. In addition to a simple supply of current from the local power supply system to the base structure 2 it can also implement further functions. For example, transformer devices or additional fuses such as overvoltage fuses can be provided. After the power supply module 3 has applied power, i.e. current to the base structure 2, it is possible for the power distribution module 4 to supply power, which it receives via the base structure 2, to the connected (here not shown) loads. A communication module 5 is also fitted to base structure 2 and is used for data transmission with known control or monitoring systems. For this purpose data lines 15 are provided in addition to the power lines 14 on base structure 2. By means of said data lines it is possible for the communication module 5 to receive/send information or instructions to or from the power supply module 3 and power distribution module 4. For example, it can determine the exact position of the individual modules on the base structure. Several power distribution modules can also be simultaneously fitted and used on the base structure 2.

FIG. 2 is a plan view of the power bar system 1, which is equipped with three different power distribution modules 4 in the form of socket strips or boards 17, 18, 19. Socket strip 17 is provided with connections for "Schuko" plugs (DIN 49440). Socket strip 18 has IEC 320 sockets. Sockets according to the US three-pin plug standard are e.g. provided on socket strip 19. It is possible to provide all desired socket types, including three-phase or multiphase sockets. Through the implementation of the power distribution module in modular form it can be easily replaced and adapted to local circumstances and standards. As shown in FIG. 2, it is also possible to operate different types of socket strip 17, 18, 19 with one base structure 2.

The socket strips 17, 18, 19 have in addition for each circuit a display device 13. The latter can e.g. display if the load connected to said socket is receiving power or whether a problem or fault has occurred. A power supply module 3 is fitted to the left-hand end of base structure 2. Said power supply module 3 has three display devices 13, which are used for displaying the three available phases. If a fault has occurred and a phase can no longer provide the desired power, this can be displayed by the corresponding display device 13.

In a simplified form the display device only displays "malfunction" or "function".

Operating devices for the locking devices are provided in the end regions of socket strips 17, 18, 19.

The base structure 2 shown in FIG. 2 has both power supply lines 14 and data lines 15. In FIG. 2 there are five power supply lines 14 and at least four data lines 15.

The exact construction of the base structure 2 and the fitting of a module 3, 4 or 5 to said base structure 2 will be described relative to FIGS. 3 and 4.

The base structure 2 shown in FIG. 3 has five power supply lines 14. This base structure 2 is provided for the use with a three-phase current system. Power line 21 is used for the first phase, power line 22 for the second phase and power line 23 for the third phase. Power line 24 e.g. serves as a neutral conductor and power line 25 for the PE-conductor (protective earth). The power lines 21, 22, 23, 24, 25 shown are designed as female contact devices 32. For contacting and power transmission purposes module 4 has male contact devices 33 adapted thereto for power transmission. Data lines 15 and the corresponding contact devices 35 and 34 are implemented in a similar manner to contact devices 32 and 33 for power transmission. However, as high power levels are not transmitted via data lines 15, they can be given smaller dimensions. The number of both the power lines 14 and data lines 15 is dependent on the specifically used system, e.g. the communication system.

On fitting a module 4 it is not always necessary for all five power lines 14 to be contacted by module 4. If a module is only operated in single phase form, i.e. only one phase is available for the load, it is e.g. sufficient to have contacting only with power lines 21, 24 and 25.

In order to achieve a good contact between base structure 2 and module 4 in its lateral regions the latter is equipped with projecting coupling elements 26 which, when said module 4 is mounted on the base structure or telescoped therewith, engage in corresponding counterparts 27 on the base structure. As the coupling elements 26 are provided in the lower module areas, it is also possible to provide modules which are wider than the base structure 2. This permits the use of electronic subassemblies with particularly wide plugs.

In order to make difficult an undesired release of a module 3, 4, 5 fitted to a base structure 2, a locking device 16 is additionally provided on said modules 3, 4, 5. As shown in FIG. 5, locking device 16 engages in the recess 30 provided. In the form shown here the locking device 16 is in the form of a pin with a cross-pin at right angles thereto. By rotating locking device 16 by 90° the cross-pin can no longer be drawn out of the base structure 2 and module 3, 4, 5 is fixed to the latter. Fundamentally other locking constructions are also possible.

FIG. 5 shows a contact device 37 for the PE conductor in a different form from that of FIGS. 3 and 4. Here, compared with the other power lines, it is positioned higher, so that module 3, 4, 5 firstly contacts said contact device 37 on engagement, so that there is a leading earth or ground, which increases protection and safety.

The design of the power lines 14 and data lines 15 is such that they are not exposed on base structure 2. This prevents an undesired contacting or short-circuiting between the individual lines 21, 22, 23, 24, 25, 14 and 15.

The contact devices can e.g. be constructed as blade contacts and with a corresponding base plate. A design with spring contacts is also possible. Other contact devices bringing about a positive and/or non-positive connection also are usable.

FIG. 6 shows a server cabinet 43, which has two power rail systems 41 and 42. Power bar or power rail system 41 is positioned vertically, whereas power bar system 42 is fitted horizontally. There is further space for fitting additional modules in the case of power bar system 41. These modules can be inserted during operation, because in the case of contacting the other modules are not influenced. With the inventive power bar system 1 individual modules can also be replaced during the operation of the power bar without the entire power bar system having to be removed from the mains.

FIG. 7 shows a double power bar system 51 comprising two power bars engaging on one another. To transmit the power form from power supply module 3 to the second bar, at least one end piece 52 is constructed as a coupling element. On said coupling element 52 there are connections for the power and data lines 14 and 15, so that the power from power supply module 3 passes to both power bars. This also applies for information which is passed via communication module 5 to base structures 2. In the power bar system 51 shown in FIG. 7 two base structures are juxtaposed or fitted back to back. It is also possible with one coupling element to superimpose two base structures or arrange them one upon the other, so that they have a greater height. Thus, a vertical, longer power bar system 41 can be e.g. built up from a horizontal power bar system 42 with the aid of such a coupling element and a further base structure.

Thus, the power bar system according to the invention provides a simple, flexible concept for making more flexible the power supply in electronic cabinets.

The invention claimed is:

1. A power rail system, particularly for casings and cabinets in the information technology field, comprising a power-conducting base structure, and at least one module for power distribution or power supply fittable to the base structure, wherein said power-conducting base structure over substantially the entire length has at least power lines constructed as first contact devices, wherein said at least one module for power distribution or power supply has second contact devices for contacting with said first contact devices of said base structure, wherein contacting takes place at a random location on or with said base structure, wherein said at least one module for power distribution is implemented in the form of a socket strip, wherein said power-conducting base structure is designed for distributing several, particularly three phases, wherein said at least one module for power distribution is designed for tapping one or more phases, as desired, and wherein said first and second contact devices are provided with a contact protection.

2. The power rail system according to claim 1, wherein said base structure has data lines constructed as third contact devices.

3. The power rail system according to claim 2, wherein said at least one module has a fourth contact device for contacting with said third contact devices.

4. The power rail system according to claim 1, wherein a communication module is provided comprising at least one fourth contact device for contacting with at least one third contact device and which is constructed for transmitting and/or receiving information on data lines.

5. The power rail system according to claim 1, wherein said at least one module has tong-like coupling elements for engaging with said base structure.

6. The power rail system according to claim 3, wherein said first and third contact devices are constructed as female and alternatively as male contact devices and that said second and/or fourth contact devices are constructed as male and alternatively as female contact devices.

7. The power rail system according to claim 1, wherein said at least one module,particularly in the end regions, has at least one locking device in order to lock said at least one module on or to said base structure at the random location.

8. Power rail system according to claim 1, wherein said at least one module for power distribution or power supply has devices for transmitting or receiving information on data lines.

9. The power rail system according to claim 4, wherein there is at least one interface for communication with control systems on or in said communication module and that said at least one module has devices for the in particular bidirectional control via said data lines.

10. The power rail system according to claim 1, wherein said at least one module has display devices for outputting status information.

11. The power rail system according to claim 1, wherein said base structure has end pieces designed for connection to a further power-conducting base structure.

12. The power rail system according to claim 1, wherein said at least one module for power distribution has standard-specific connection devices for loads or conduction.

13. A power rail system, particularly for casings and cabinets in the information technology field, comprising:

a power-conducting base structure;

at least one data line within the base structure;

a plurality of sockets, wherein each socket of said plurality of sockets has a display device for outputting status information; and at least one module for power distribution or power supply fittable to the base structure, wherein:

said power-conducting base structure over substantially the entire length has at least power lines constructed as first contact devices, said at least one module for power distribution or power supply has second contact devices for contacting with said first contact devices of said base structure, contacting takes place at a random location on or with said base structure, said at least one module for power distribution is implemented in the form of a socket strip, said power-conducting base structure is designed for distributing three electrical phases, said at least one module for power distribution is designed for tapping one or more phases, as desired, said first and second contact devices are provided with a contact protection, and said at least one data line is constructed as a third contact device.

14. The power rail system according to claim 13, wherein said display device for outputting status information is an LCD monitor that displays information pertaining to a power load.

* * * * *

UNITED STATES PATENT AND TRADEMARK OFFICE

CERTIFICATE OF CORRECTION

PATENT NO. : 7,891,993 B2
APPLICATION NO. : 12/442671
DATED : February 22, 2011
INVENTOR(S) : Arthur Huber et al.

It is certified that error appears in the above-identified patent and that said Letters Patent is hereby corrected as shown below:

Column 6,
Lines 54-55, claim 4, “and/or” should be --and--.
Line 62, claim 6, “and/or” should be --and--.

Column 7,
Line 3, claim 8, “or” should be --and--.

Signed and Sealed this
Third Day of May, 2011

David J. Kappos

David J. Kappos
*Director of the United States Patent and Trademark Office*